United States Patent [19]

Jay

[11] Patent Number: 5,016,792

[45] Date of Patent: May 21, 1991

[54] BACKPACK CONVERTIBLE CHAIR

[76] Inventor: John C. Jay, 18 Sea St., Manchester, Mass. 01944

[21] Appl. No.: 482,637

[22] Filed: Feb. 21, 1990

[51] Int. Cl.[5] ..... A45F 4/02

[52] U.S. Cl. ..... 224/155; 224/153; 297/17; 297/129

[58] Field of Search ..... 224/155, 153, 156; 297/183, 229, 17, 129

[56] References Cited

U.S. PATENT DOCUMENTS

| | | | |
|---|---|---|---|
| 3,266,686 | 8/1966 | Griffith | 224/9 |
| 3,307,758 | 3/1967 | Platt | 224/9 |
| 3,309,134 | 3/1967 | Roberts | 297/17 |
| 3,662,932 | 5/1972 | Kerschner | 224/9 |
| 3,828,992 | 8/1974 | Cerchione | 224/156 |
| 4,286,739 | 9/1981 | Silcott et al. | 224/156 |
| 4,300,707 | 4/1981 | Kjaer | 224/155 |
| 4,487,345 | 12/1984 | Pierce et al. | 224/155 |
| 4,530,451 | 7/1985 | Hamilton | 224/155 |
| 4,577,901 | 3/1986 | Phillips | 297/17 |
| 4,676,548 | 6/1987 | Bradbury | 297/129 |
| 4,687,248 | 8/1987 | Ross et al. | 297/17 |
| 4,773,574 | 8/1988 | Burgard | 224/155 |
| 4,885,812 | 12/1989 | Lindner | 224/156 |
| 4,955,517 | 9/1990 | Maresca | 224/156 |

*Primary Examiner*—Henry J. Recla
*Assistant Examiner*—Keith Kupferschmid
*Attorney, Agent, or Firm*—Donald N. Halgren

[57] ABSTRACT

A convertible backpack assembly for carrying items therewithin, yet provides a readily adaptable assembly for conversion to a "beach"-type chair. The assembly includes a frame base and forward and rearward frame portions each attached to the frame base by a ratchet arrangement. A pair of leg members extend downwardly from the frame base. The forwardmost leg member is pivotably attached to the frame base so as to be swingable away from the lower back of the carrier of the convertible backpack assembly. Envelopes of webbed material may be disposed over the frame portions and across the frame base, to define the front and back of the backpack as well as the back, seat and leg support portions of the "chair". The seat portion may have its tension adjusted under the frame base, to allow greatest sitter comfort. A pair of side panels of webbed material are removably disposed between the forward and rearward frame portions to define the sides of the backpack assembly. The webbed side panels may also be secured together under the frame base.

1 Claim, 3 Drawing Sheets

10
12
14
16
18
24
26
28
30
32
40
42
44
46
50
52
54
62
64
70
72
II
II

BACKPACK CONVERTIBLE CHAIR

BACKGROUND OF THE INVENTION

1. Field of the Invention

This invention relates to backpacks, and more particularly, to a backpack which converts into a chair.

2. Prior Art

Most convertible "backpack/beachchair" carrying-type devices are typically cumbersome, uncomfortable foldable chairs which are able to provide some sort of load carrying capabilities.

One such chair is shown in U.S. Pat. No. 4,530,451, wherein a storage bag is attached to a foldable chair frame. Another pack is shown in U.S. Pat. No. 3,266,686, which utilizes chains and pivotable links to create a chair from a backpack frame. U.S. Pat. No. 4,487,345 shows a folding (typically wooden) chair with a container attached to its backside.

U.S. Pat. No. 4,577,901 discloses a folding chair with carrier straps, and a cushioning pad to minimize discomfort to the lower back of the person carrying the chair. Platt U.S. Pat. No. 3,307,758 shows a bag and backrest which includes ropes to hold the seat and back together in proper supporting position. Kerschner U.S. Pat. No. 3,662,932 discloses a box-like pack which converts to a stool. This utilizes frame components which are unscrewed from the pack and reattached to make legs for the stool. U.S. Pat. No. 4,286,739 shows a frame set-up which when collapsed, may act as a backpack, and when unfolded, may make a chair, with the bag portion hanging from side rails of the pack.

U.S. Pat. No. 4,300,707 discloses a foldable chair with carrying straps, which chair frame might be usable to hold a bag. Bradbury U.S. Pat. No. 4,676,548 shows a foldable beach type chair with a carrying bag attached to its backside.

U.S. Pat. No. 4,773,574 discloses a foldable frame which is adapted to carry a bag, when the frame is folded. This frame appears particularly uncomfortable for the lower back of the carrier.

The prior art discloses primarily chairs with carrying bags attached, with little concern for the comfort of the carrier or the user of the chair.

It is an object of the present invention, to overcome these limitations and to provide a practical backpack which readily converts into a chair, having a variety of configurations, each of which configuration is comfortable and convenient for its carrier and/or user.

BRIEF SUMMARY OF THE INVENTION

The present invention provides a backpack, capable of carrying large loads in a frame protected configuration, which frame is comfortable and adjustable for its carrier, and which backpack is readily convertible to an adjustable chair.

The backpack frame includes a first frame portion which is articulably attached to a frame base which includes a pair of side rails, through a pair of ratchet devices, and a second frame portion also articulably attached to the frame base, by a further pair of ratchet devices.

A forward leg member is also articulably arranged, with respect to said frame base, and on the downwardly directed side thereof, with respect to said first frame portion. A rearward leg member, comprising a portion of said frame base, is arranged fixedly downwardly opposed to said second frame portion.

When the first and second frame portions are generally parallel and approximately perpendicular with respect to the side rail portions of the frame base, the device is in the backpack configuration. The forward leg member may be pivoted rearwardly (away from the wear's back). The frame assembly is also covered appropriately by an arrangement of envelopes of convas web and carriable by straps, to permit the backpack to be "wearer ready".

In converting the backpack to a beach chair, the side panels of the backpack "container" are unattached (unzippered) along their side portions from their adjacent seat and back portions which comprise the web envelopes disposed on the first and second frame portions.

The side panels are then folded under the bottom of the frame base, and are attached to one another thereacross. The first and second frame portions may then be ratcheted away from one another to form the back and seat/leg support portions, and the forward leg member on the frame base may be pivoted downwardly, so that the whole frame assembly then defines a chair configuration. In converting from a beach chair to a backpack configuration, the opposite steps would undertaken.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figures 1, 2:
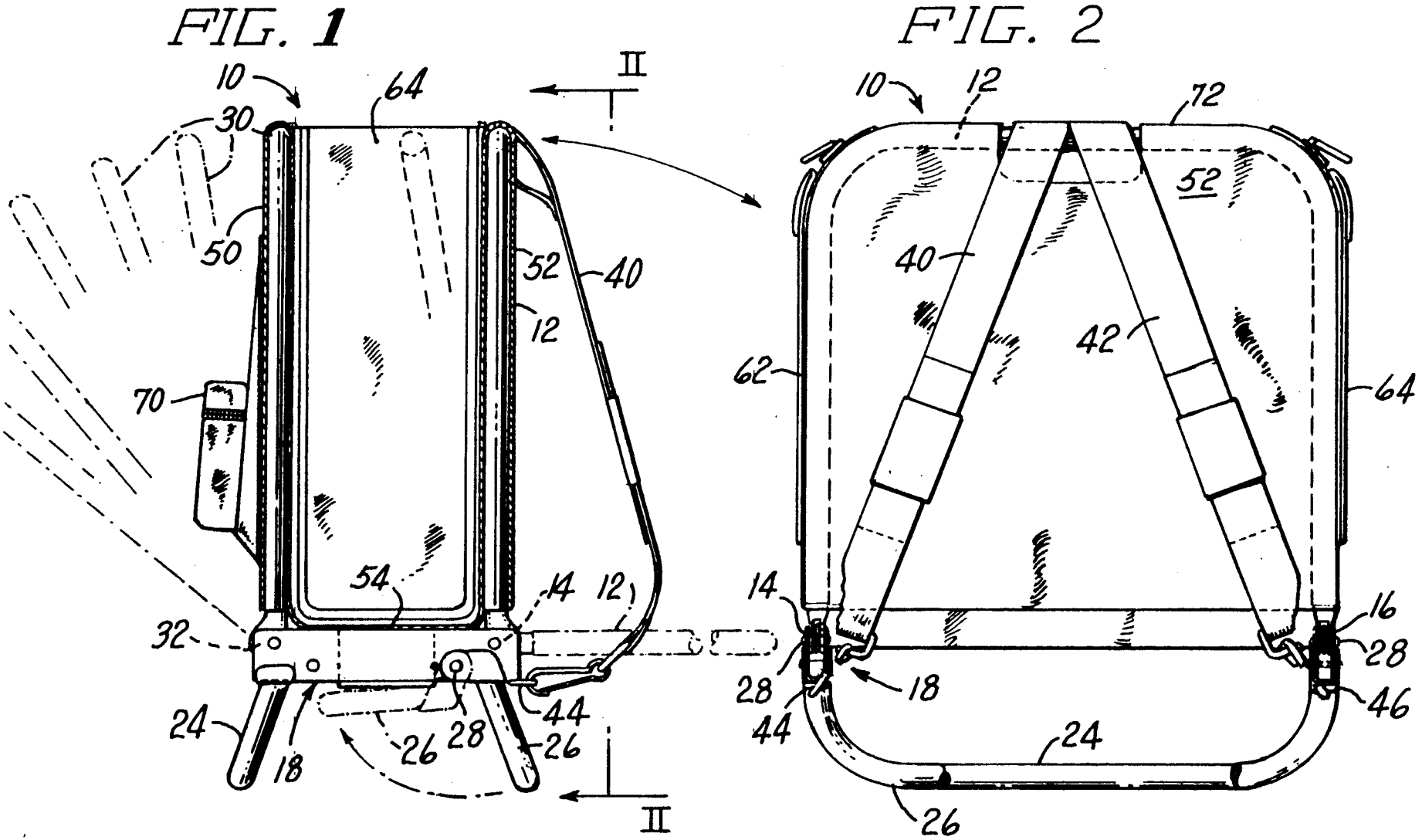
FIG. 1 is a side elevational view of the present invention in its backpack configuration.
FIG. 2 is a view taken along the lines II—II of FIG. 1.
Figure 4:
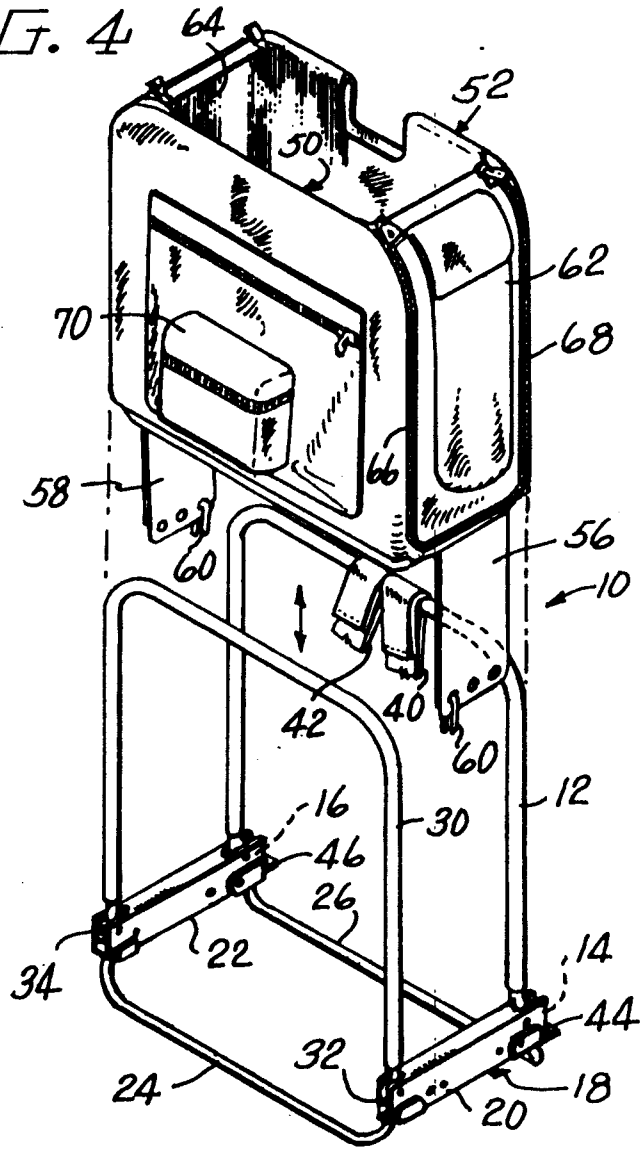
FIG. 4 is an exploded perspective view of the frame and canvas web therewith.
Figure 3:
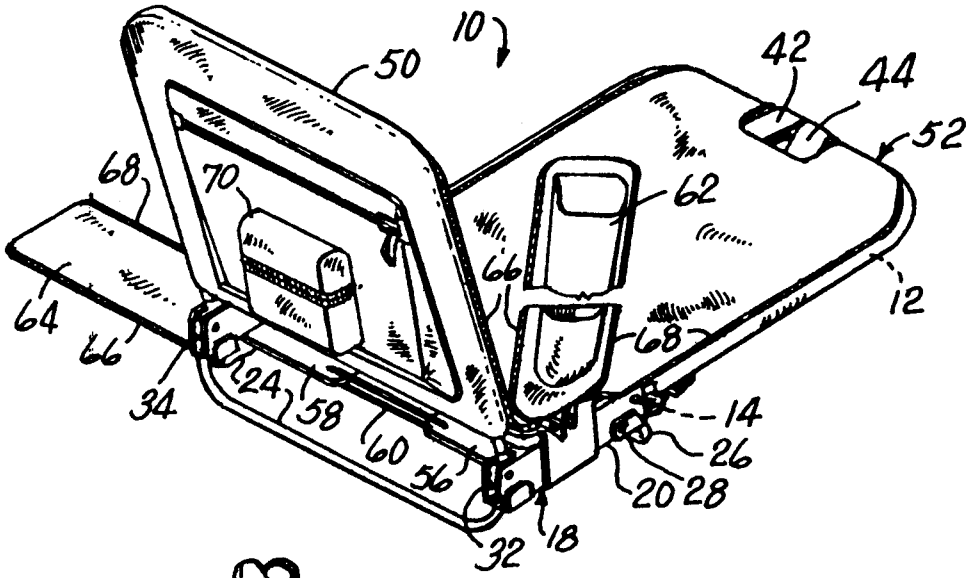
FIG. 3 is a perspective view of the present invention in one of its chair configurations.
Figure 5:
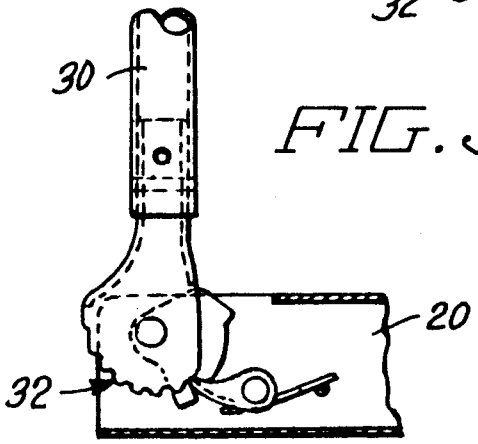
FIG. 5 is a side elevational view of one of the ratchet mechanisms of the present invention.
Figure 6:
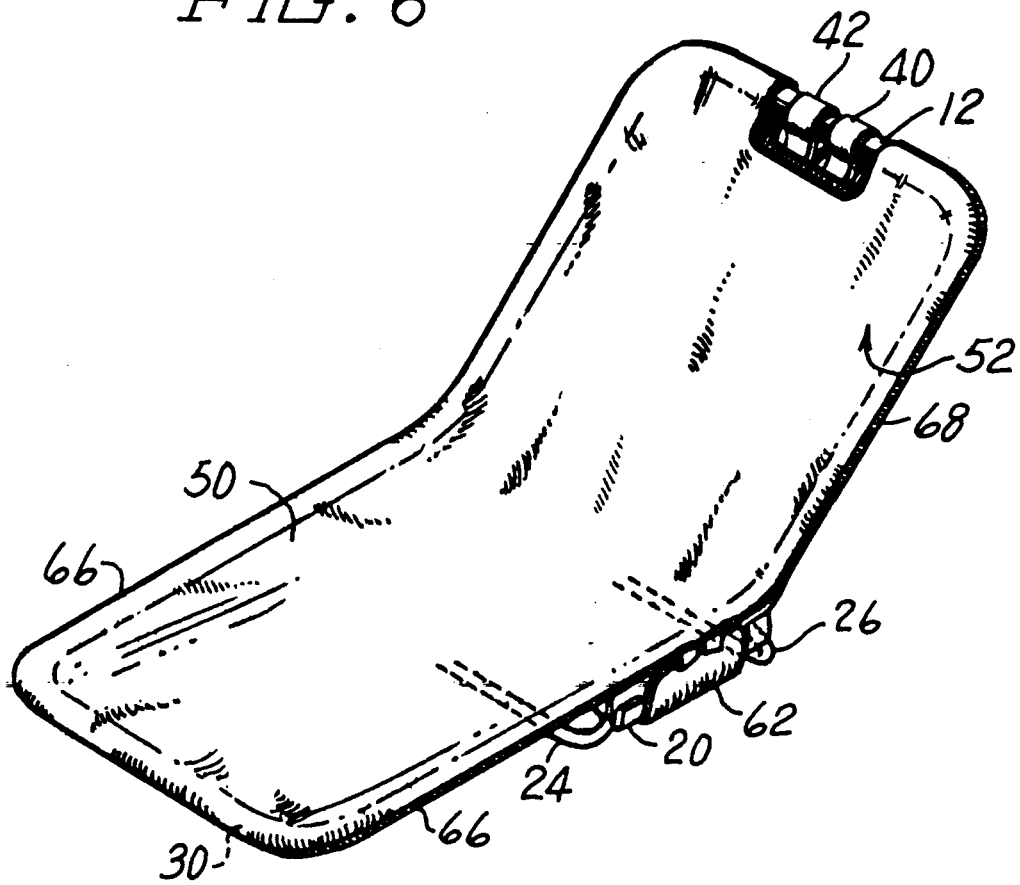
FIG. 6 is a perspective view of the invention as a chair in on of its reclining open configurations.

Referring to the drawings now in detail, and particularly to FIGS. 1 and 2 there is shown a convertible backpack assembly 10 in its backpack configuration. The convertible backpack assembly 10 includes a forward or first frame portion 12 of generally inverted U-shape, manufactured preferably from tubular aluminum or steel. The first frame portion 12 is articulably secured by a pair of ratchet members 14 and 16 preferably made from steel, to a frame base 18, which comprises a pair of transversely adjacent parallel rails 20 and 22. The frame base 18 has a forward end and a rearward end. A slightly angularly rearwardly disposed U-shaped rearward leg member 24 is fixedly secured to the rearward end of each rail 20 and 22, as shown in FIGS. 1 and 4. A U-shaped forward leg member 26 is swingably secured by a pair of hinge devices 28 to the forward end of each parallel rail 20 and 22, as shown in FIGS. 1, 3 and 4. The side view of FIG. 1, shows in phantom lines how the forward leg member 26 may be swung rearwardly on its hinge devices 28, so as to be held under the frame base 18, and out of the way when desired.

A rearward or second frame portion 30 of generally inverted U-shaped configuration, as best shown in FIGS. 1 and 4 is articulably secured by a pair of ratchet members 32 and 34, to the frame base 18. The second frame portion 30 is similar to first frame portion 12, except that they are arranged to ratchedly pivot apart (away) from one another, as may be seen in FIGS. 1 and 3.

A pair of adjustable shoulder carrying straps 40 and 42 are each secured to the upper portion of the first frame member 12, and to lower loops 44 and 46 at the forward end of each of the parallel side rails 20 and 22.

A back canvas web envelope 50 is disposed about the second frame portion 30, and a front canvas web envelope 52 is disposed about the first frame portion 12, as shown in FIGS. 3 and 4. A bottom panel of canvas web 54 is connectively disposed between the front and back canvas web envelopes 52 and 50, as shown in FIG. 1. A pair of bottom flaps 56 and 58 extend from the sides of the bottom panel canvas web 54, as shown in FIGS. 3 and 4. The bottom flaps 56 and 58 are adapted to wrap around the outside portions of the parallel side rails 20 and 22 which comprise the frame base 18. Each bottom flap 56 and 58 has a securement means 60 such as a tie cord so as to adjustably tighten and tension the bottom panel canvas web 54 to the frame base 18. A pair of elongated canvas side panels 62 and 64 are attached to the bottom panel canvas web 54, as also shown in FIGS. 3 and 4. A pair of securement means 66 and 68 such as zippers extend along the long edges of each side panel 62 and 64, and the sides of each canvas web envelope 50 and 52.

Figure 7:
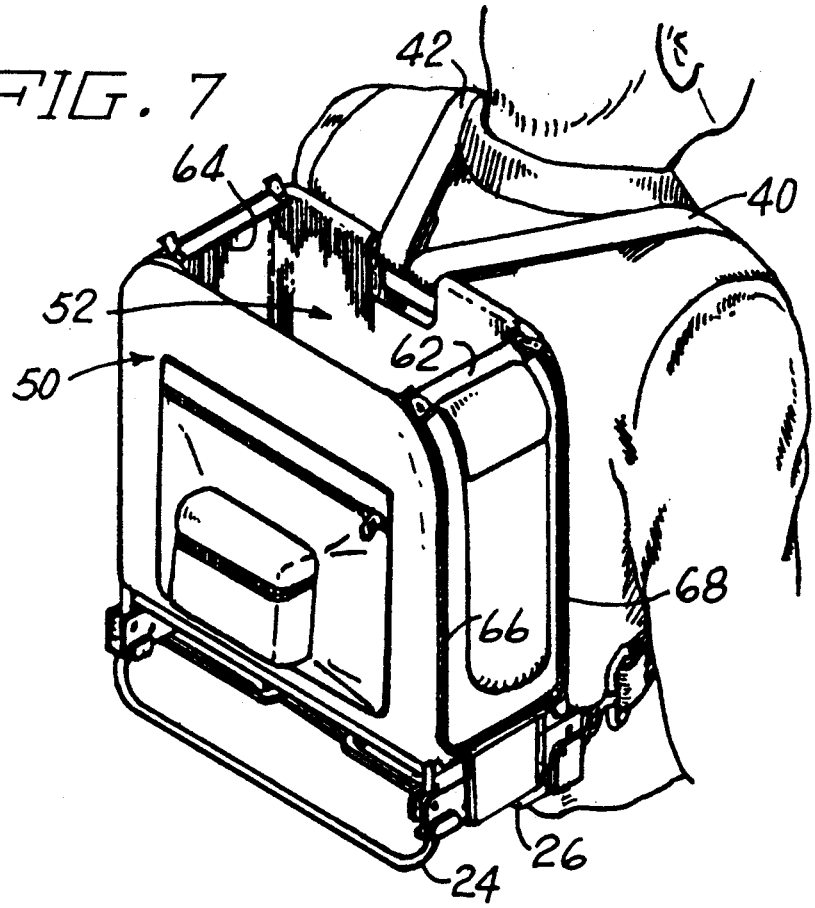
FIG. 7 is a perspective view of the invention as a backpack in its cargo carrying configuration, being carried on the back of a person.

When the side panels 62 and 64 are fully secured (zippered) to the canvas web envelopes 50 and 52 as best shown in FIGS. 4 and 7, they define the side wall portions of the backpack, in which goods may be carried by an individual.

When the convertible backpack assembly 10 is being utilized as a backpack, the forward leg member 26 is pivoted rearwardly as shown in phantom in FIG. 1, and also shown in FIG. 7, so as to be out of the way and not pressing against and otherwise injuring the wearer's (carrier's) lower back.

When it is desired to utilize the convertible backpack assembly 10 as a (beach-type) chair, the forward leg member is arranged in its downward orientation, as shown in FIGS. 1, 3 4 and 6. The contents of the backpack assembly 10 are removed, and the side panels 62 and 64 are unzippered. Each side panel 62 and 64 may have securement type means therewith, so as to permit them to wrap securely under the bottom flaps 56 and 58 and attach to one another.

The first frame portion 12 with its canvas web envelope 52 may be rocked to disengage its ratchet members 14 and 16, and then rotated into its generally horizontal leg supporting orientation, as shown in FIG. 3, although it may also be disposed at a non-horizontal orientation. The second frame portion 30 with its canvas web envelope 50 may similarly be articulated so as to be inclined at an obtuse angle with respect to the frame base 18, which may comprise the "back" portion of the now configured "chair" assembly, and the bottom panel 54 comprising the "seat" thereof. Actually, either canvas web 50 or 52 may comprise the back of the chair and the remaining one, the "leg support" portion. The opposing frame portions 12 and 30 are thus able to go from being parallel, through a ratching range into which they can become generally coplanar.

An addition pocket 70 may be arranged on the back portion of the canvas web envelope 50 for further storage capabilities. A hood, not shown, may be secured to the distal edge 72 of the canvas web envelope 52 on the first frame portion 12, so as to provide a cover for the backpack configuration. The web need not be of canvas, but may be comprised of any flexible, durable material. Additionally, the web may be easily removed and replaced from the frame by merely untying the cord 60 which holds the webs 56 and 58 taughtly together, removing (lifting) the front and back canvas web envelopes 50 and 52 from the frames 12 and 30, and dropping a new web envelope arrangement onto those frames 12 and 30, and merely securing it under the frame 18, by retying the cords 60 between the new flaps 56 and 58.

Thus there has been shown a novel framework which when fitted with sheaths or pockets and panels of web material, may be articulated from a backpack containment configuration to a multi-position beach type chair which permits comfortable carrying as a backpack and allows adjustable tensioning and juxtaposition of the "chair" components.

I claim:

1. A convertible backpack assembly for enclosing and carrying items on the back of a carrier, said assembly adaptable to a multi-position chair, comprising:

a rearward webbed frame portion defining a backside of said backpack assembly and also comprising a backside of said multi-position chair;

a forward webbed frame portion defining a front side of said backpack assembly and comprising a leg support of said multi-position chair;

a base portion of webbed material defining the bottom of said backpack assembly and also comprising a seat portion of said multi-position chair, a base frame portion the rearward and forward frame portions attached through a ratchet arrangement to said base frame portion; and a rearward leg member secured to a rearward end of said base frame portion and a forward leg member hingedly attached to a forward end of said base frame portion so as to be pivoted away from the carrier's lower back to permit ease of carrying by a shoulder strap arrangement disposed between said forward frame portion and said base frame portion of said backpack assembly by allowing the forward leg member to be pivoted out of contact with the carrier thereof;

said forward and rearward webbed frame portions being comprised of tubular members in a generally inverted U-shaped configuration, with an envelope of webbed material disposed thereover said webbed base portion connected to said forward and rearward webbed frame portions; and said webbed base seat portion having tension adjustment means arranged therewith, so as to permit compliance with the user of the multi-position chair;

said tension adjustment means comprising strap means interconnecting portions of said web material of said seat portion and wrapped around said base frame portion for tensioning said webbed base seat portion around said base frame portion.

* * * * *